US005184785A

United States Patent [19]

Inger et al.

[11] Patent Number: 5,184,785

[45] Date of Patent: Feb. 9, 1993

[54] DOUBLE-SIDED TEXTILE MACHINE HAVING A PLURALITY OF WINDING UNITS FOR PRODUCING CROSS-WOUND PACKAGES

[75] Inventors: Siegfried Inger, Krefeld; Heinz Stenmans, Grefrath, both of Fed. Rep. of Germany

[73] Assignee: Palitex Project Company GmbH, Krefeld, Fed. Rep. of Germany

[21] Appl. No.: 840,397

[22] Filed: Feb. 24, 1992

Related U.S. Application Data

[63] Continuation-in-part of Ser. No. 739,788, Jul. 31, 1991, abandoned, which is a continuation of Ser. No. 466,940, Jan. 18, 1990, abandoned.

[30] Foreign Application Priority Data

Jan. 21, 1989 [EP] European Pat. Off. ..... 89101042.3

[51] Int. Cl.[5] ..... B65H 67/06

[52] U.S. Cl. ..... 242/35.50 A; 57/281

[58] Field of Search ..... 242/35.5 A, 35.5 R; 57/281

[56] References Cited

U.S. PATENT DOCUMENTS

| | | | |
|---|---|---|---|
| 3,552,666 | 1/1971 | Stenmanns et al. | 242/35.5 R |
| 4,171,779 | 10/1979 | Kamp | 242/35.5 A |
| 4,496,110 | 1/1985 | Raasch et al. | 242/35.5 A |
| 4,541,577 | 9/1985 | Suzuki et al. | 242/35.5 A |
| 4,572,447 | 2/1986 | Raasch | 242/35.5 A |
| 4,582,270 | 4/1986 | Asai et al. | 242/35.5 A |
| 4,657,194 | 4/1987 | Wey et al. | 242/35.5 A |
| 4,690,342 | 9/1987 | Langen | 242/35.5 A |
| 4,721,262 | 1/1988 | Langen | 242/35.5 A |
| 4,856,270 | 8/1989 | Langen et al. | 57/281 |
| 4,878,342 | 11/1989 | Kawarabashi | 242/35.5 A X |
| 4,925,000 | 5/1990 | Pacakova et al. | 242/35.5 A |
| 4,928,895 | 5/1990 | Wey | 242/35.5 A |

FOREIGN PATENT DOCUMENTS 0274626 7/1988 Fed. Rep. of Germany

*Primary Examiner*—Stanley N. Gilreath
*Attorney, Agent, or Firm*—Bell, Seltzer, Park & Gibson

[57] ABSTRACT

A double-sided textile machine comprising a plurality of winding units for producing cross-wound packages, in particular a two-for-one twisting machine, and further comprising a device for collecting and conveying the produced packages, which device includes two transport means moving in the region of the machine center in the longitudinal direction in the interior of the machine, which means are directly superposed in at least two planes and of which each can be loaded at least from one machine side. A package delivery station is arranged at the end of the transport system. The transport systems may comprise two superposed conveyor belts, a transfer mechanism for delivering the cross-wound packages from one conveyor belt to the other conveyor belt. The transport systems may also comprise a plurality of package cages, which move in the longitudinal direction of the machine, each package cage comprising two superposed repositories for one package each.

6 Claims, 6 Drawing Sheets

DOUBLE-SIDED TEXTILE MACHINE HAVING A PLURALITY OF WINDING UNITS FOR PRODUCING CROSS-WOUND PACKAGES

This application is a continuation-in-part of application Ser. No. 07/739,788, filed Jul. 31, 1991, now abandoned, which is a continuation of application Ser. No. 07/466,940, filed Jan. 18, 1990, now abandoned.

FIELD OF THE INVENTION

This invention relates to a textile yarn processing machine, such as a two-for-one twister, having a plurality of spindle assemblies for processing yarn and forming wound packages of process yarn and arranged on the machine in two longitudinally-extending rows on opposite sides of the machine and in spaced side-by-side relationship, and a yarn package transporting mechanism extending longitudinally through the yarn processing machine between the rows of spindle assemblies for receiving wound packages of yarn doffed from the spindle assemblies on each side of the machine and transporting the packages out of the machine.

BACKGROUND OF THE INVENTION

Such textile machines are constructed as multi-position machines. This means that many identical working units, such as, for example, winding units for producing cross-wound packages, are positioned side by side in a desired length. When installing such machines, the floor space plays an important role, and consequently it is necessary to construct the machines with a narrowest possible spacing between the individual working positions and with a limited width.

It is known to use conveyor belts or overhead conveyors, which are in most cases accommodated in the region of the central longitudinal axis of the machine inside the machine frame. The finished cross-wound packages are delivered or doffed either by hand or by handling devices to these conveyors. In the case of a double-sided textile machine the problem arises that the package conveyor belts can be loaded only or hold the equivalent number of doffed wound yarn packages from one machine side. Only after having emptied the package conveyor belt or overhead conveyor is it possible to handle the other machine side or the equivalent number of doffed wound yarn packages.

Likewise, it is already known to arrange two conveyor belts along the center axis of a textile machine.

In these known apparatus, the package conveyor belts are arranged side by side in one plane and move in opposite direction. One end of the two conveyor belts accommodates a device for transferring the packages from one conveyor belt to the other. In this known apparatus, the packages can be separately removed from each machine side and transported to the machine end with a time delay. The disadvantage of such an apparatus is that it leads to an excessively wide textile machine, which will greatly affect the room conditions when the machines are installed.

Further known is an automatic winding machine with a traveling package doffer, which comprises a package conveyor belt and a package gripping and lifting device arranged above the conveyor belt and serving as an expanded storage, to which the packages can be delivered from the conveyor belt and temporarily stored thereon. However, the packages on the gripping and lifting device are not transported, but must again be returned to the conveyor belt for their further transportation.

OBJECT AND SUMMARY OF THE INVENTION

The object underlying the present invention is to design and construct a double-sided textile machine of the type set forth above to which this invention relates such that the cross-wound packages can simultaneously be removed on both sides of the textile machine, without having to accept a substantial widening of the machine.

This object may be accomplished in accordance with the present invention by providing in a textile yarn processing machine, such as a two-for-one twister, having a plurality of spindle assemblies for processing yarn and forming wound packages of process yarn and arranged on the machine in two longitudinally-extending rows on opposite sides of the machine and in spaced side-by-side relationship, and a yarn package transporting mechanism extending longitudinally through the yarn processing machine between the rows of spindle assemblies for receiving wound packages of yarn doffed from the spindle assemblies on each side of the machine and transporting the packages out of the machine; the improvement of the yarn transporting mechanisms including two conveying means arranged in at least two planes one directly on top of the other for receiving doffed wound yarn packages in the upper of the two planes and for storing doffed wound yarn packages in the lower of the two planes.

In accordance with one preferred embodiment of this invention, the two conveying means comprise superimposed top and bottom conveyor belts mounted for movement in opposite directions in the two planes, and a transfer device positioned at the ends of the conveyor belts in the direction of movement of the top conveyor belt for receiving doffed yarn packages from the top conveyor belt and transferring the yarn packages to the bottom conveyor belt. This transfer device preferably comprises a rotating paddle wheel mechanism having paddles adapted to receive and transfer the yarn packages between conveyor belts. With this arrangement, the wound yarn packages are doffed from the spindle assemblies on both sides of the machine on the top conveyor belt for movement to the transfer mechanism which receives the doffed wound yarn packages and transfers them to the lower conveyor belt for storage until they are conveyed out of the machine.

In a second preferred embodiment, the two conveying means are in the form of a plurality of cages individually and sequentially suspended from a guide rail extending longitudinally of the machine for movement along the guide rail from one end of the machine to the other end of the machine. Each of the cages has two superimposed top and bottom package receptacles mounted for vertical movement between a first position in which said bottom receptacle is in said upper plane for receipt of a doffed yarn package and a second position in which said bottom receptacle having a doffed yarn package therein is in said lower plane for storing the package and said top receptacle is in said upper plane for receipt of another doffed yarn package. Each of said cages further includes vertically extending guide rods for movably receiving the package receptacles for movement between the first and second position. A spring in each of the cages is operatively connected with the package receptacles for biasing the package receptacles into the first position and allowing the receptacles to move against such bias to the second position under the weight of the doffed yarn package received in the bottom package receptacle.

Both embodiments accomplish that the transport occurs in two planes, without having to accept a substantially increased machine width.

BRIEF DESCRIPTION OF THE DRAWINGS

The following will describe in more detail examples for the two basic embodiments of the present invention with reference to the drawings, in which.

DETAILED DESCRIPTION OF THE PREFERRED EMBODIMENTS OF THE INVENTION

Figure 1:
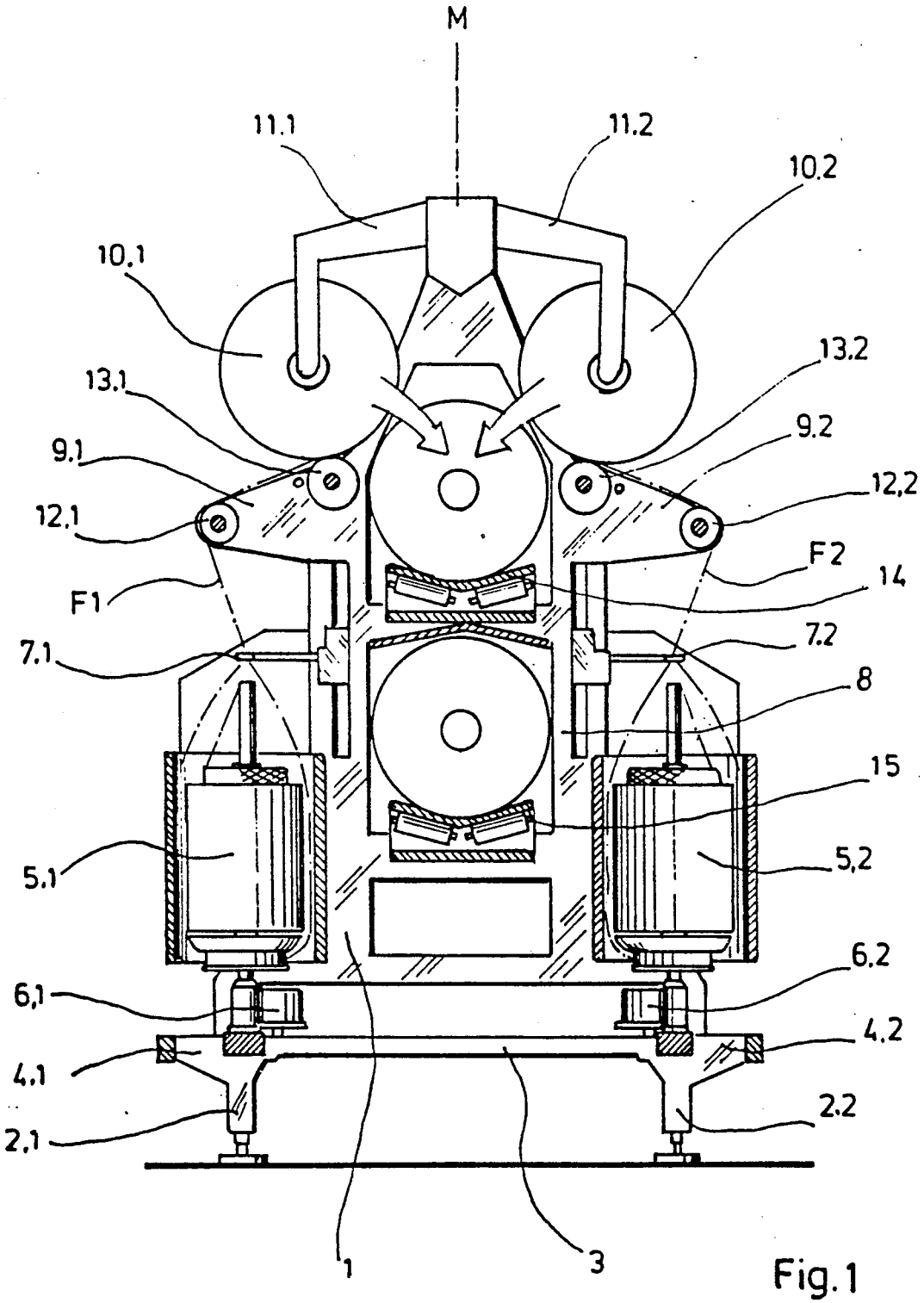
FIG. 1 is a greatly schematized, cross sectional view of a two-for-one twisting machine with a transport system for cross-wound packages comprising two conveyor belts.

Shown in FIG. 1 is a double-sided two-for-one twisting machine comprising a machine frame 1, which rests on feet 2.1 and 2.2 interconnected by a cross beam 3. Arranged on each of the two longitudinal sides of the machine frame 1 is a spindle rail 4.1 and 4.2 respectively, on which standard-type two-for-one twisting spindles 5.1 and 5.2 are arranged, which are driven via spindle drives 6.1 and 6.2.

A plurality of such two-for-one twisting spindles is arranged on each side in the-longitudinal direction of the machine.

Arranged in the center of the machine frame 1 is a riser 8, which supports base plates 9.1 and 9.2 respectively for the members of a takeup system above the two-for-one twisting spindles 5.1 and 5.2. Mounted above the base plates 9.1 and 9.2 are package holders 11.1 and 11.2 for the packages 10.1 and 10.2. A yarn F1 or F2 to be wound respectively advances in known manner from the balloon of the two two-for-one twisting spindles 5.1 and 5.2 through a yarn guide eyelet 7.2 or 7.2 and over overfeed rolls 12.1 and 12.2 to the cross-wound packages 10.1 and 10.2 which are driven by friction rolls 13.1 and 13.2.

A transport system extending in the longitudinal direction in the interior of the machine frame 1 and comprising an upper conveyor belt 14 arranged in the region of the loading plane and a lower conveyor belt 15 arranged therebelow, serves to remove the cross-wound packages 10.1 and 10.2 , which are produced.

Figure 1A:
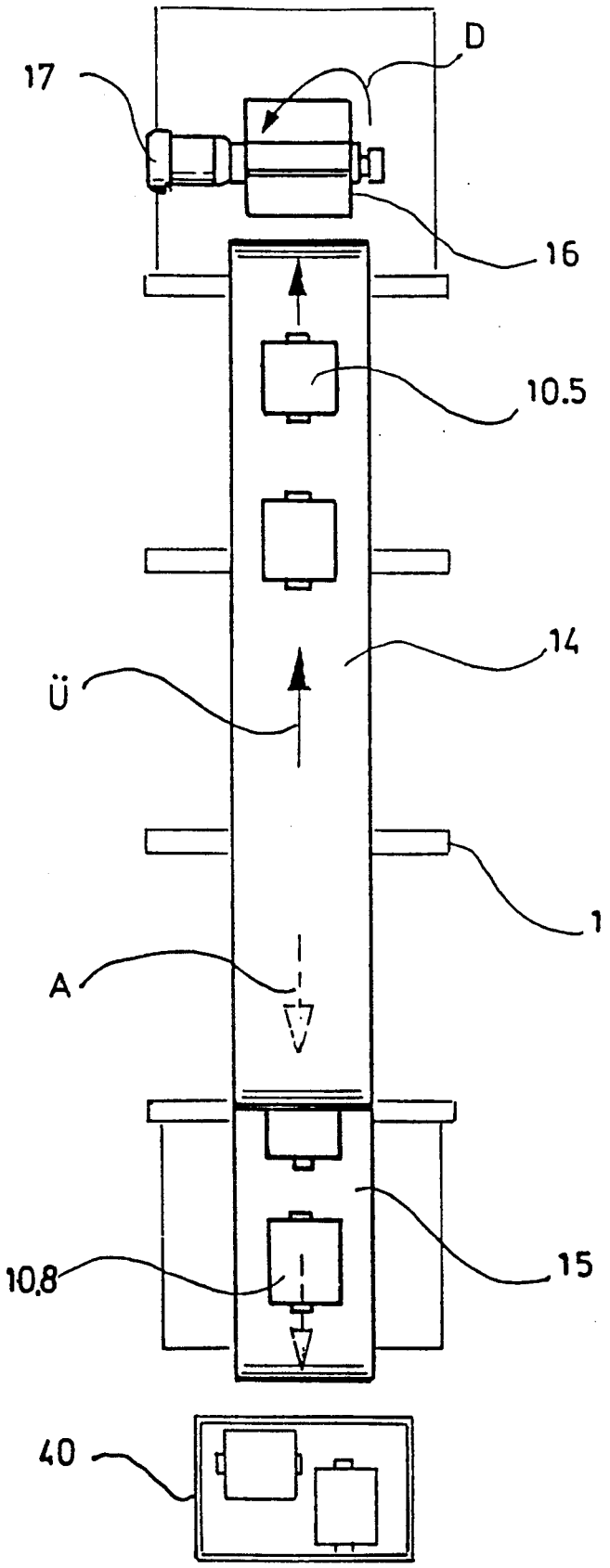
FIG. 1*a* is a greatly schematized top view of the transport system of the two-for-one twisting machine of FIG. 1.
Figure 2:
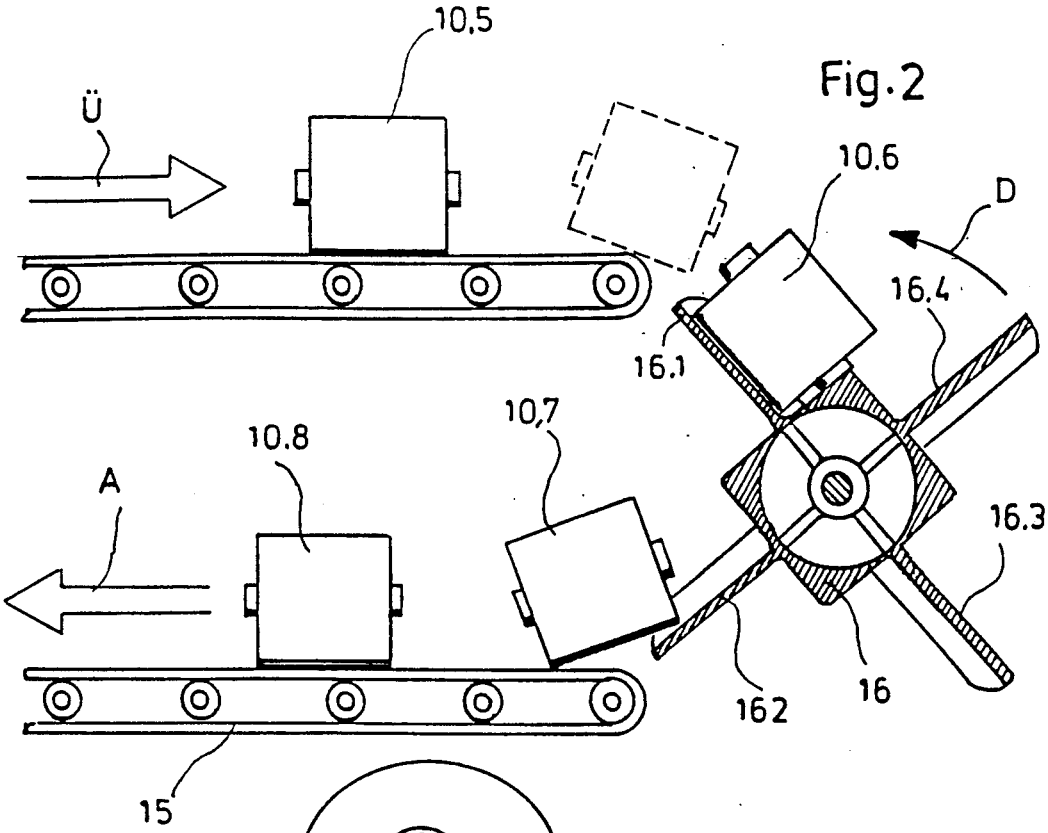
FIG. 2 is a side view, partially cut, of the transport system in the machine of FIG. 1 in the region of a transfer mechanism.
Figure 3:
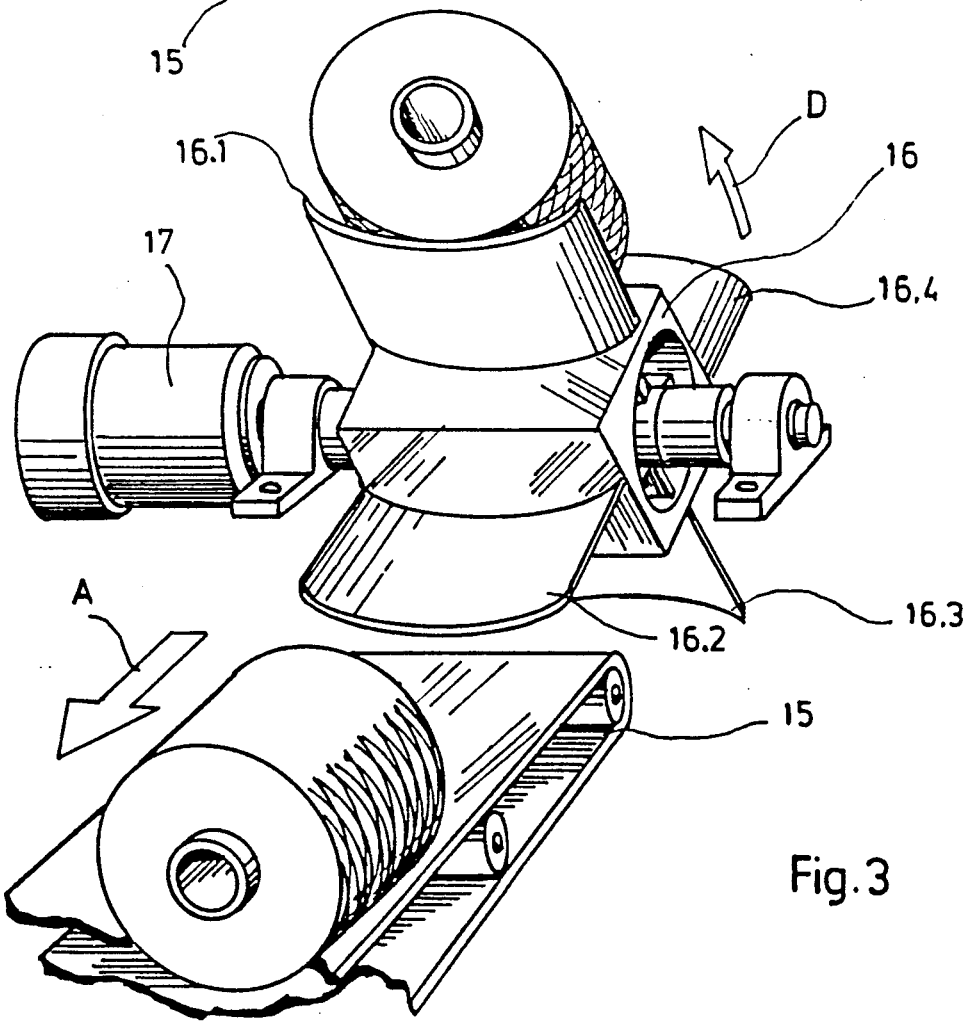
FIG. 3 is a perspective view of the transfer mechanism of FIG. 2.

As can be better seen schematically in FIGS. 1*a* and 2, the two conveyor belts 14 and 15 move in the longitudinal direction of the machine in opposite directions to each other. While the lower conveyor belt 15 moves in the direction A to a package delivery station at the machine end, the upper conveyor belt 14 moves in direction of arrow Ü to a transfer mechanism 16, which delivers the cross-wound packages deposited on the upper conveyor belt in the region of the loading plane to the lower conveyor belt 15. The latter transports the packages to a package delivery station, where they are delivered, for example, into a buggy 40.

The transfer mechanism 16 comprises a paddle wheel driven by a motor 17 and being provided with four paddles 16.1, 16.2, 16.3 and 16.4, which are each adapted to receive a cross-wound package. The paddle wheel 16 rotates stepwise in direction of arrow D.

The operation of the transport system is as follows: As can be noted from FIG. 1, the produced packages 10.1 and 10.2 are placed from both machines sides on the upper conveyor belt 14 in the region of the loading plane. The movement of this conveyor belt 14 is so controlled that it starts to move when a package 10.5 is deposited and stops again after this package is delivered to the transfer mechanism 16. Shown in FIG. 2 is how a cross-wound package 10.6 is already on the transfer device 16, and how another cross-wound package 10.7 is placed by the transfer device 16 on the lower conveyor belt 15, which holds already a further cross-wound package 10.8. The movement of the lower conveyor belt 15 is so controlled that, when it receives a package 10.7 from the transfer device 16, it moves on by one package length in direction of arrow A, i.e. toward the package delivery station. Said otherwise, the lower conveyor belt serves in addition as a device for the temporary storage of the cross-wound packages delivered onto the upper conveyor belt 14. The particular drives and controls for the above operation are not illustrated and described herein, as suitable drives and controls are well known to those with ordinary skill in the art, and illustration and description of such drives and controls are not necessary for an understanding of the present invention. However, the above-described sequence of operation may also be done manually by an operator viewing the machine and the transport system so that the operator can manually actuate conventional drives for the conveyor belts 14 and 15 so that the conveyor belt 14 can be stopped at a twisting spindle 5.1, 5.2 for doffing of a package 10.1, 10.2 from such spindle onto the conveyor belt 14. The operator then manually actuates the drive of the conveyor belt 14 to move it forward until such package 10.5 is placed on the transfer mechanism 16. The operator would then manually actuate the drive 17 for the transfer mechanism 16 to rotate to a position to deposit the package 10.7 on the conveyor 15, the drive of which is then manually actuated by an operator to move the package away from the transfer mechanism 16 for temporary storage. The mechanism for doffing the packages 10.1, 10.2 from the package holders 11.1, 11.2 may be constructed in accordance with the apparatus disclosed in U.S. Pat. No. 3,552,666, assigned to the assignee of the present invention, which is incorporated herein by reference.

Shown in FIGS. 4–7 are two different embodiments of transport systems for a two-for-one twisting machine, which may correspond as to its other parts not shown to the machine of FIG. 1.

Figure 4:
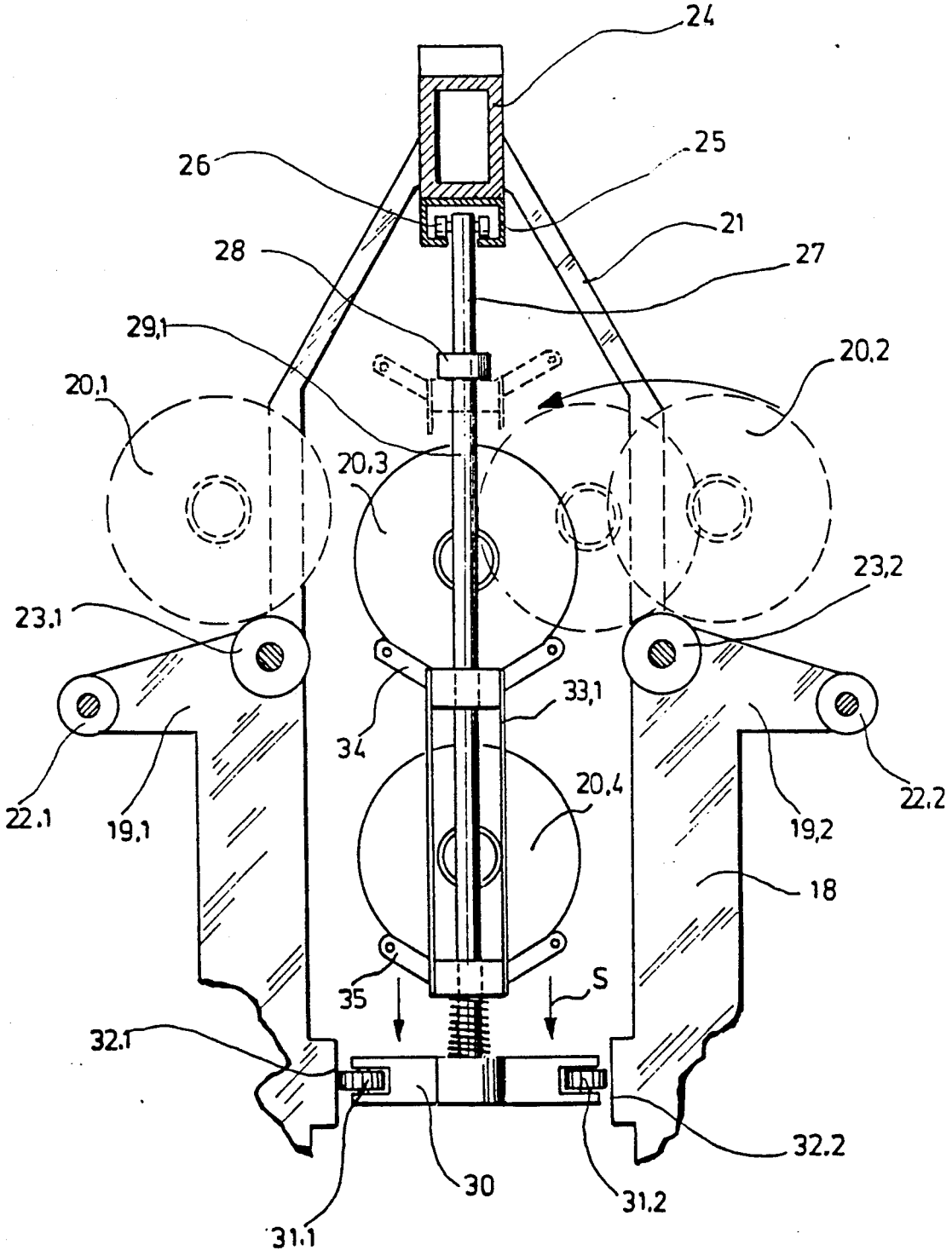
FIG. 4 is a partial sectional view of a two-for-one twisting machine with a transport system for the cross-wound packages in the form of an overhead conveyor.
Figure 5:
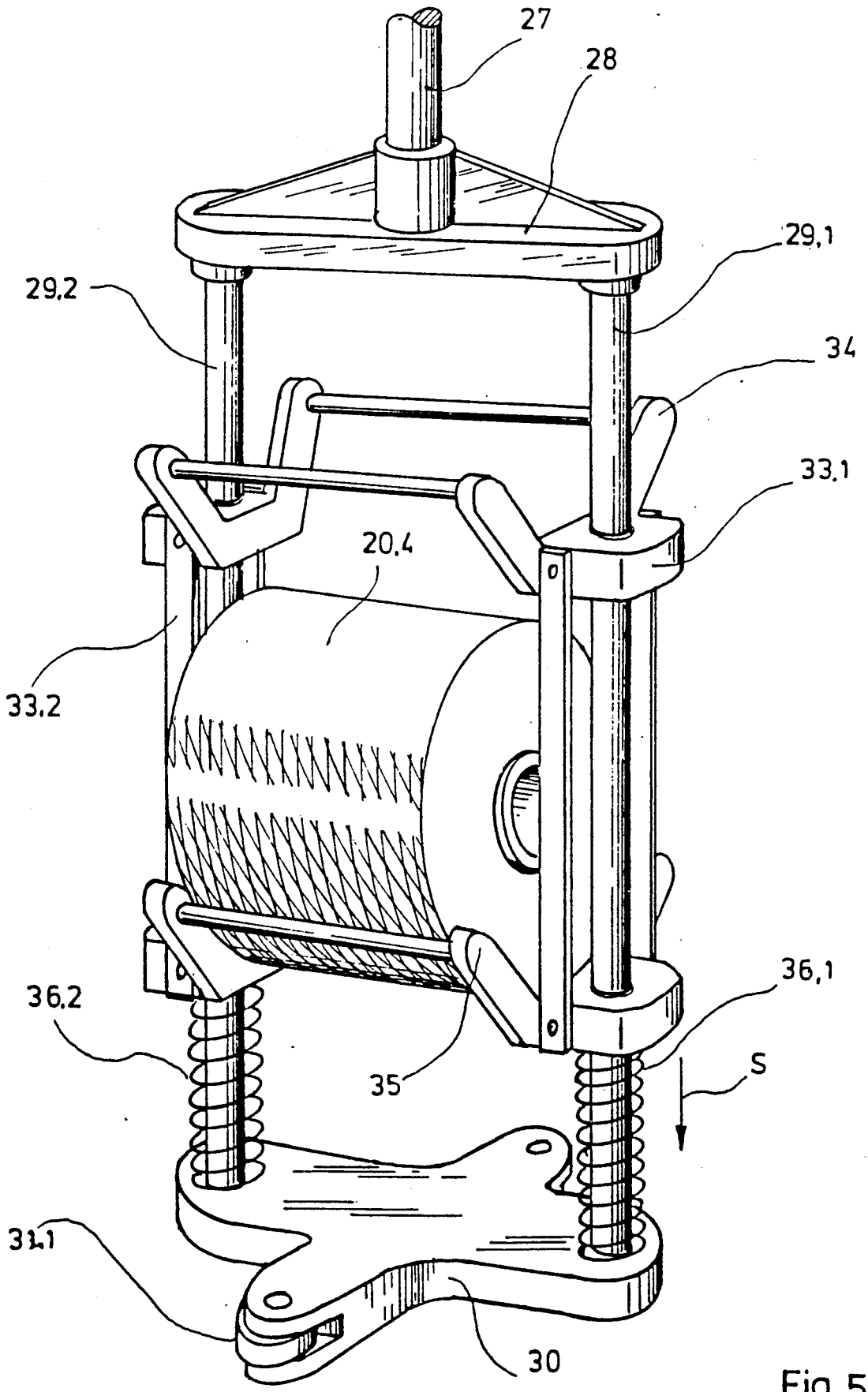
FIG. 5 is a perspective view of a package cage of the transport system of FIG. 4.

The transport system of FIGS. 4 and 5, which is arranged in the interior of the machine, is designed and constructed as an overhead conveyor.

Again, the transport system is arranged in the longitudinal direction of the machine in the region of the longitudinal center plane within a riser 18 placed on the frame not shown, to which base plates 19.1 and 19.2 are mounted for accommodating members of the takeup system, such as overfeed rolls 22.1 and 22.2 and friction rolls 23.1 and 23.2

Mounted on the riser 18 are supports 21, on which a longitudinal beam 24 is arranged with a guide rail 25 attached thereto.

From this guide rail 25 a plurality of package cages suspend, one of which is shown in detail in FIG. 5, which move in the longitudinal direction of the machine in direction toward a package delivery station and return along a path not shown outside the machine. Each of such package cages are constructed as shown in FIG. 5 and are mounted as shown in FIG. 4.

Each of these package cages is suspended on a carrier arm 27, which moves on rolls 26 along the guide rail 25. The package cage is provided with a mounting bracket, which suspends from the carrier arm 27 and comprises a cross beam 28 and two round bars 29.1 and 29.2, the latter being interconnected at their lower end by a base plate 30. Along the round bars 29.1 and 29.2, slides 33.1 and 33.2 are arranged for a vertical displacement. The two upper ends of the slides are interconnected by an upper package receptacle 34, and the two lower ends of the slides likewise by a lower package receptacle 35. The two package receptacles 34 and 35 are displaceable in direction of arrow S from an upper position shown in dashed lines in FIG. 4 to a lower position shown in solid lines against the force of compression springs 36.1 and 36.2 by the weight of a cross-wound package 20.4 deposited in the lower receptacle 35.

The base plate 30 is guided on rolls 31.1 and 31.2 to move along rails 32.1 and 32.2, which are arranged on the riser 18 and extend in the longitudinal direction of the machine.

The above-described transport system operates as follows: As long as it is unloaded, the package cage is in its upper position, in which the lower receptacle 35 is arranged in the region of the loading plane. As soon as one of the packages 20.1 or 20.2 shown in dashed lines in the region of the loading plane, is completely wound, it is delivered to the lower package receptacle 35, as is shown in the case of package 20.4, which is indicated in solid lines in FIGS. 4 and 5. The weight of the package 20.4 pushes the package cage to a lower position, in which the upper receptacle 34 is in the region of the loading plane. It is now possible to deliver the other package from respectively the other machine side to the receptacle 34, as is indicated, for example, by the numeral 20.3 in FIG. 4. The now loaded package cage moves, driven by a drive mechanism not shown, in the longitudinal direction of the machine to the package delivery station, where is its unloaded and moved on. The particular drives and controls for the above described operation are not illustrated and described herein, as suitable drives and controls for accomplishing this operation are well known to those with ordinary skill in the art, and illustration and description of such drives and controls are not necessary for an understanding of the present invention. However, reference is made to U.S. Pat. No. 4,856,270, assigned to the assignee of the present invention, wherein a transport system for doffed wound yarn packages from spindle assemblies of a similar machine is shown. The yarn package carrying devices or cages of that prior U.S. patent do not include the novel feature of top and bottom package receptacles as set forth herein which allows doffing of wound yarn packages from both sides of the machine. Moreover, the sequence of operation described above may be performed manually by an operator without the necessity for automatic controls, if desired. In that regard, a desired package cage forming a part of a train of package cages, as disclosed in U.S. Pat. No. 4,856,270, would be manually stopped by stopping the drive thereof by an operator when such cage reached a desired spindle in the machine. The package 20.1, 20.2 would then be doffed, such as by a mechanism disclosed in the above-mentioned U.S. Pat. No. 3,552,666, into the cage and the drive of the train of cages, as illustrated in the aforementioned U.S. Pat. No. 4,856,270, could be manually actuated by an operator to move forward. The remaining sequence as described above could also be manually controlled by the operator.

In this instance, the transport system has in addition the characteristic of a temporary storage, in that the packages stored in the lower receptacles 35 are simultaneously carried along.

Naturally, it is not absolutely necessary to successively load each conveying cage at one position from the two machine sides. Rather, the conveying cage loaded with one package can also be moved on and receive a second package at a different position from one of the two machine sides.

Figures 6, 7:
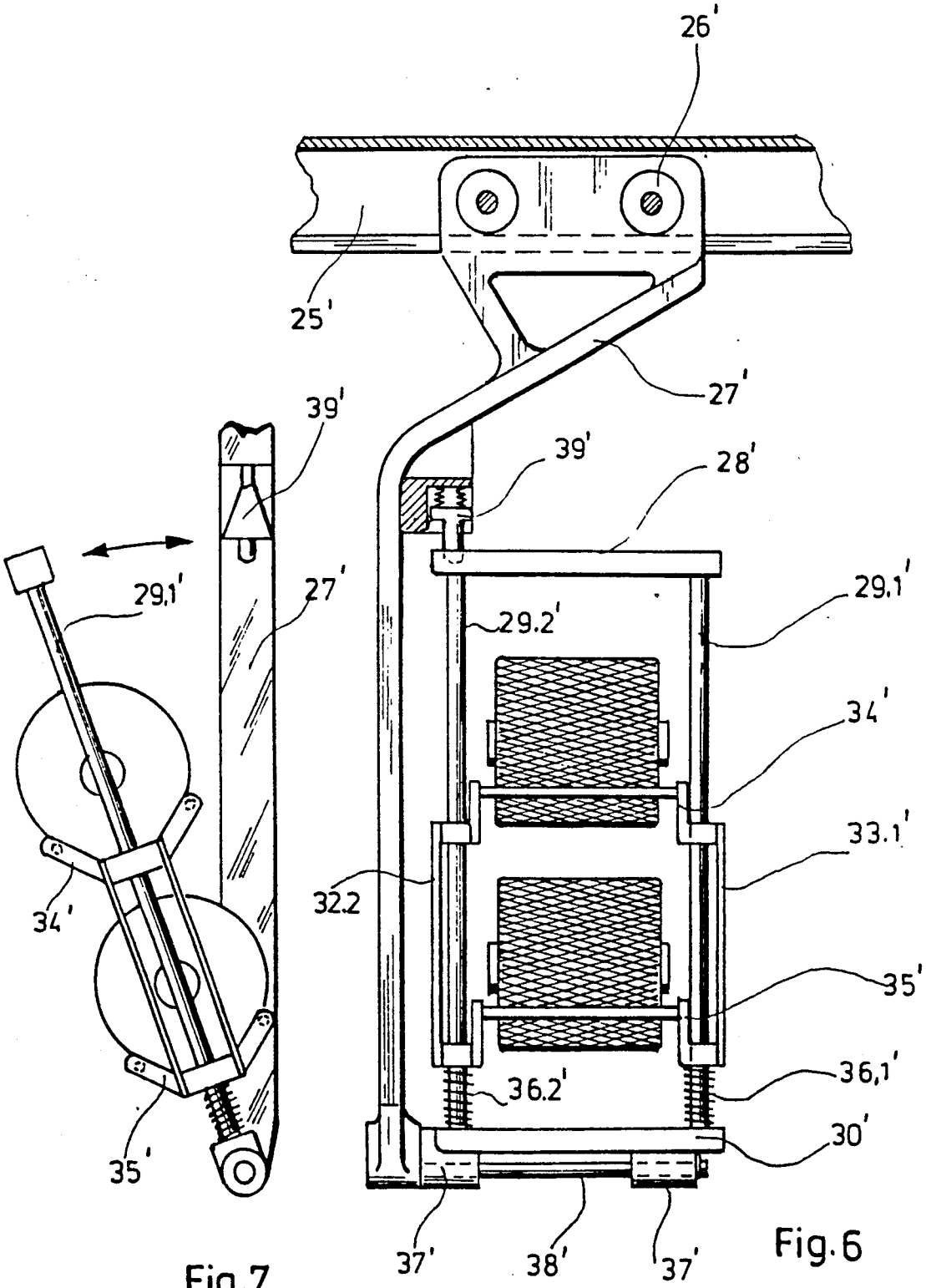
FIG. 6 is a side view of another embodiment of a conveying cage for the machine of FIG. 4.
FIG. 7 is a front view of a conveying cage of FIG. 6.

FIGS. 6 and 7 show a variant of an overhead conveyor with several package cages, the other parts of the two-for-one twisting machine, the interior of which accommodates the overhead conveyor being left out in the illustration.

The package cage illustrated in FIGS. 6 and 7 suspends from a carrier arm 27', which moves on rolls 26' in a guide track 25' extending in the longitudinal direction of the machine. Arranged at the lower end of carrier arm 27' is a bracket rotatable about a shaft 38' and comprising an upper cross beam 28', two vertically extending round bars 29.1' and 29.2', which are connected with the upper cross beam 28', and a lower cross beam 30', on which shackles 37' are arranged, which embrace shaft 38' and form with same a swivel joint. The upper cross beam 28' is connected with the carrier arm 27' via a releasable locking mechanism 39'.

Slides 33.1' and 33.2' move, ag described hereinabove, along the round bars 29.1' and 29.2', and accommodate an upper package receptacle 34' and a lower package receptacle 35'. The package receptacles 34' and 35' move under the weight of at least one cross-wound package against the force of compression springs 36.1' and 36.2' from an upper to a lower position.

The package cages are loaded with cross-wound packages, and move in the longitudinal direction of the machine in the same manner as described with reference to FIGS. 4 and 5. To remove the packages from the receptacles at the package delivery station, the locking mechanism 39' is released, as can be seen in FIG. 7, and the bracket swivels transversely to the direction of movement of the package cage, so that the packages can be easily removed from the receptacles 34' and 35'.

What is claimed is:

1. In a textile yarn processing machine, such as a two-for-one twister, having a plurality of spindle assemblies for processing yarn and forming wound packages of processed yarn and arranged on said machine in two longitudinally-extending rows on opposite sides of said machine and in spaced side-by-side relationship, and a yarn package transporting mechanism extending longitudinally through said yarn processing machine between said rows of spindle assemblies for receiving wound packages of yarn doffed from said spindle assemblies on each side of said machine and transporting the packages out of said machine; the improvement of:

said yarn transporting mechanism including two conveying means arranged in at least two planes one directly on top of the other for receiving doffed wound yarn packages from each side of the machine, in the upper of said two planes and for storing doffed wound yarn packages in the lower of said two planes.

2. In a textile yarn processing machine. as set forth in claim 1, in which said two conveying means comprise superimposed top and bottom conveyor belts mounted for movement in opposite directions in said respective two planes, and transfer means positioned at the ends of said conveyor belts in the direction of movement of said top conveyor belt for receiving doffed yarn packages from said top conveyor belt and transferring the yarn packages to said bottom conveyor belt.

3. In a textile yarn processing machine, as set forth in claim 2, in which said transfer means comprises a rotating paddle wheel mechanism having paddles adapted to receive and transfer the yarn packages.

4. In a textile yarn processing machine, such as a two-for-one twister, having a plurality of spindle assemblies for processing yarn and forming wound packages of processed yarn and arranged on said machine in two longitudinally-extending rows on opposite sides of said machine and in spaced side-by-side relationship, and a yarn package transporting mechanism extending longitudinally through said yarn processing machine between said rows of spindle assemblies for receiving wound packages of yarn doffed from said spindle assemblies on each side of said machine and transporting the packages out of said machine; the improvement of:

said transporting mechanism including a guide rail extending longitudinally of said machine, and a plurality of cages individually suspended from said guide rail for movement therelong, each of said cages having two superimposed top and bottom package receptacles mounted for vertical movement between a first position in which the said bottom receptacle is in said upper plane for receipt of a doffed yarn package and a second position in which said bottom receptacle having a doffed yarn package therein is in said lower plane for storing the package and said top receptacle is in said upper plane for receipt of another doffed yarn package.

5. In a textile yarn processing machine, as set forth in claim 4, further including vertically-extending guide rods in each of said cages for movably receiving said package receptacles for movement.

6. In a textile yarn processing machine, as set forth in claim 5, further including spring means in each of said cages and operatively connected with said package receptacles for biasing said bottom package receptacle into said first position and allowing said bottom package receptacle to move against such bias to said second position under the weight of the doffed yarn package received in said bottom package receptacle.

* * * * *